US006315573B1

(12) United States Patent
Hirota et al.

(10) Patent No.: US 6,315,573 B1
(45) Date of Patent: Nov. 13, 2001

(54) ARTICLE PLACING TABLE WITH AN ERASABLE WRITING DEVICE

(75) Inventors: Kashichi Hirota, Hachioji; Makoto Kaneda, Saitama-ken, both of (JP)

(73) Assignee: Kyowa Electric and Chemical Co., Ltd., Tokyo (JP)

( * ) Notice: Subject to any disclaimer, the term of this patent is extended or adjusted under 35 U.S.C. 154(b) by 0 days.

(21) Appl. No.: 09/634,254

(22) Filed: Aug. 7, 2000

(30) Foreign Application Priority Data

Aug. 10, 1999 (JP) ..... 11-226702

(51) Int. Cl.[7] ..... B43L 1/00
(52) U.S. Cl. ..... 434/409
(58) Field of Search ..... 434/408, 409, 434/413, 414, 417, 418

(56) References Cited

U.S. PATENT DOCUMENTS 4,182,938 1/1980 Neumeier .
5,820,385 * 10/1998 Ohashi et al. ..... 434/409

FOREIGN PATENT DOCUMENTS

2034640-A * 6/1980 (GB) .
2214137-A * 8/1989 (GB) .
1-151647 10/1989 (JP) .
1-151648 10/1989 (JP) .

* cited by examiner

*Primary Examiner*—D. Neal Muir
(74) *Attorney, Agent, or Firm*—Jacobson Holman, PLLC

(57) ABSTRACT

A table or base for a telephone or the like includes an outer case, a recording sheet which is retractable within the outer case and which includes a microcapsule magnetic sheet, and an erasing magnetic member disposed within the outer case. The outer case has a top surface on which the telephone and other articles can be placed. The erasing magnetic member is positioned under the recording sheet when the inner case is pushed into the outer case. Thus, pulling out the recording sheet from the outer case enables a top face of the recording sheet to be magnetically written in, and pushing the recording sheet into the outer case enables the magnetic writing on the recording sheet to be erased.

5 Claims, 12 Drawing Sheets

ARTICLE PLACING TABLE WITH AN ERASABLE WRITING DEVICE

FIELD OF THE INVENTION

The present invention relates to a table for placing thereon an article such as a telephone or the like, and more particularly to an article placing table having an erasable writing device.

BACKGROUND OF THE INVENTION

It frequently becomes necessary to take note during a telephone conversation. Thus, it is desirable to provide a writing device in association with a telephone. As one typical example for aiming to achieve this object, there has been proposed a telephone table by the Japanese Utility Model Laid-Open Publication No. Hei 1-151648, wherein a telephone table includes an inner frame member with which a telephone number table, a writing pad and a writing tool are associated. However, in this type of telephone table, the intended functions can be achieved only by regularly supplementing the writing pad and the writing tool.

Meanwhile, as a desk-use writing device capable of repeatedly writing and erasing optional characters and figures without consuming any writing pad, there has been developed a writing device in which a microcapsule magnetic sheet is disposed on an top face thereof as a recording sheet. In this kind of writing device, characters and figures can be written as desired on the top face of the recording sheet with a magnetic pen having a magnet on the tip thereof, and the characters and figures written on the top face of the recording sheet can also be erased by an erasing magnetic member which has a magnet thereon and is disposed on a back face of the recording sheet.

The theory of the above writing device will now be briefly described. As shown in FIG. 1, a microcapsule magnetic sheet 10 for use in a recording sheet of a writing device has microcapsules 11 of approximately 500 $\mu$m in diameter which are two-dimensionally arranged between a top sheet 12 and a back sheet 13. Black magnetic powders 14 dispersed in white color emulsion 15 are encapsulated in each of the microcapsules 11. Thus, when magnets 16, 17 are positioned close to the microcapsule magnet sheet 10, the black magnetic powders 14 in the microcapsule 11 are magnetically attracted so as to present a black color on one side of the microcapsule magnet sheet 10 to which the magnets 16, 17 are closely positioned. In contrast, on the other side of the microcapsule magnet sheet 10, there is produced white color area due to the presence of only the white color emulsion 15. Applying this theory of magneticphoresis to the writing device enables black color characters or figures to be written as desired on the front sheet 12 by means of the magnet 16. In addition, when the magnet 17 is positioned close to and moved along the back sheet 13 of the microcapsule magnetic sheet 10, the magnetic powders 14 in the microcapsules 11 are attracted by the magnet 17 toward the back sheet 13, so that the written characters or figures on the front sheet 12 can be erased. It may be appreciated to apply the microcapsule magnetic sheet to a writing device in association with a table or base of a telephone or the like.

However, the microcapsule magnetic sheet described above has a problem that a burdensome operation is necessary for erasing the written memorandum. Thus, it cannot exactly be achieved to enhance usability by using this kind of microcapsule magnetic sheet as a writing device for use in a mount of a telephone or the like.

SUMMARY OF THE INVENTION

It is an object of the present invention to solve the problem inherent to the conventional microcapsule magnetic sheet and to provide an improved table or base of a telephone or the like associated with a microcapsule magnetic sheet as a writing device, the microcapsule magnetic sheet being disposed in a manner that the upper surface area of the table or base can be effectively utilized when it is placed on a desk or the like.

Another object of the present invention is to provide a table or a base for a telephone or the like associated with a writing device including a microcapsule magnetic sheet having an erasing device which is easy to handle.

In order to achieve the other objects, the present invention provides a table or base associated with a writing device comprising an outer case, a recording sheet which is movable into and out of the outer case, the recording sheet including a microcapsule magnetic sheet and an erasing magnetic member disposed within the outer case. The outer case has a top surface on which a telephone or other article may be placed. The erasing magnetic member is provided so that it is positioned under the recording sheet when the recording sheet is inserted into the outer case. When the recording sheet is pulled out from the outer case, a top face of the recording sheet is exposed so as to make it possible to write in by means of a magnetic pen. When the recording sheet is pushed into the outer case, the magnetic writings on the recording sheet can be erased as the recording sheet passes over the erasing magnetic member.

DESCRIPTION OF THE PREFERRED EMBODIMENT

A preferred embodiment of the present invention will now be described with reference to the accompanying drawings.

Figure 1:
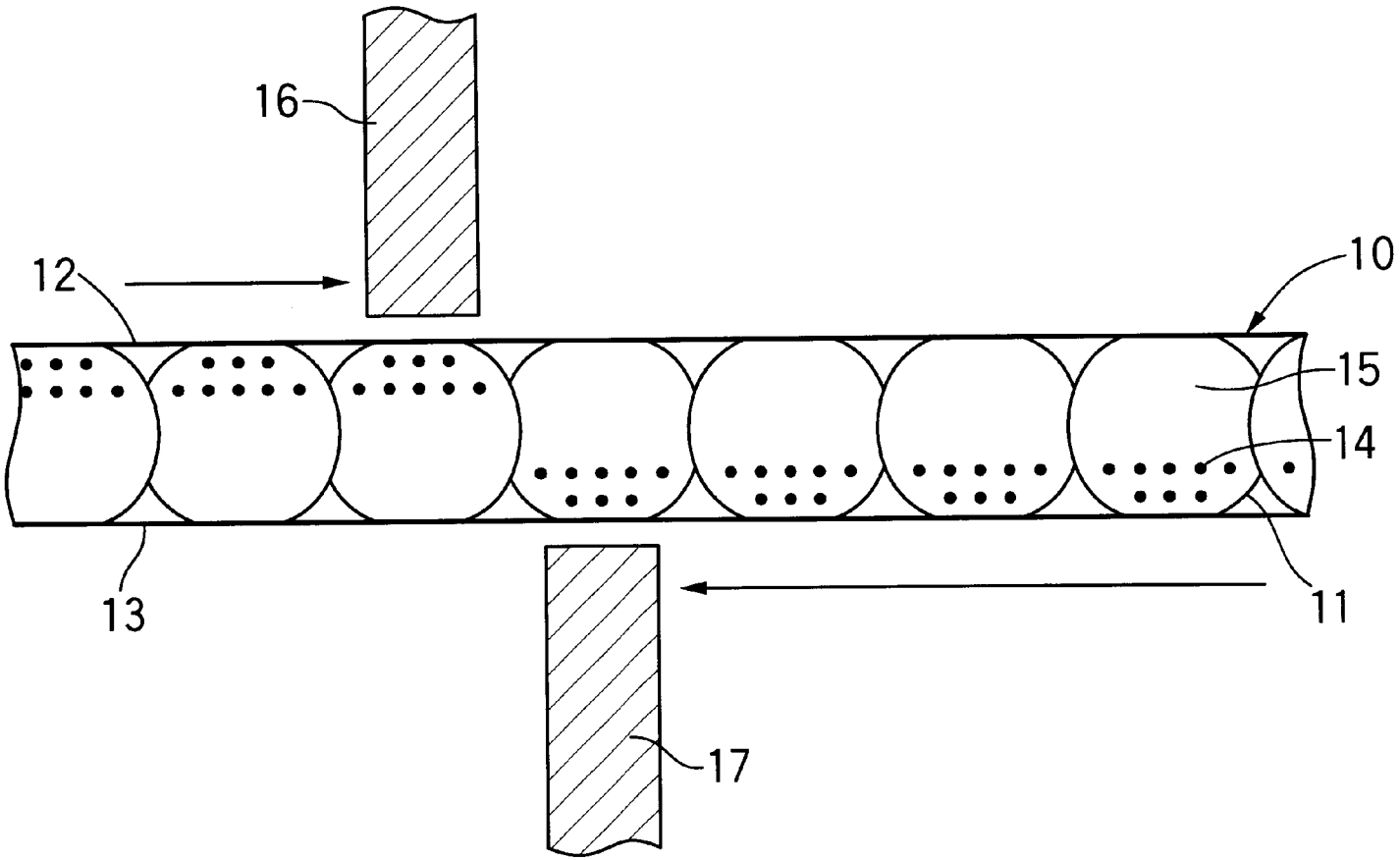
FIG. 1 (PRIOR ART)
FIG. 1 is a side view of a microcapsule magnetic sheet.
Figure 2:
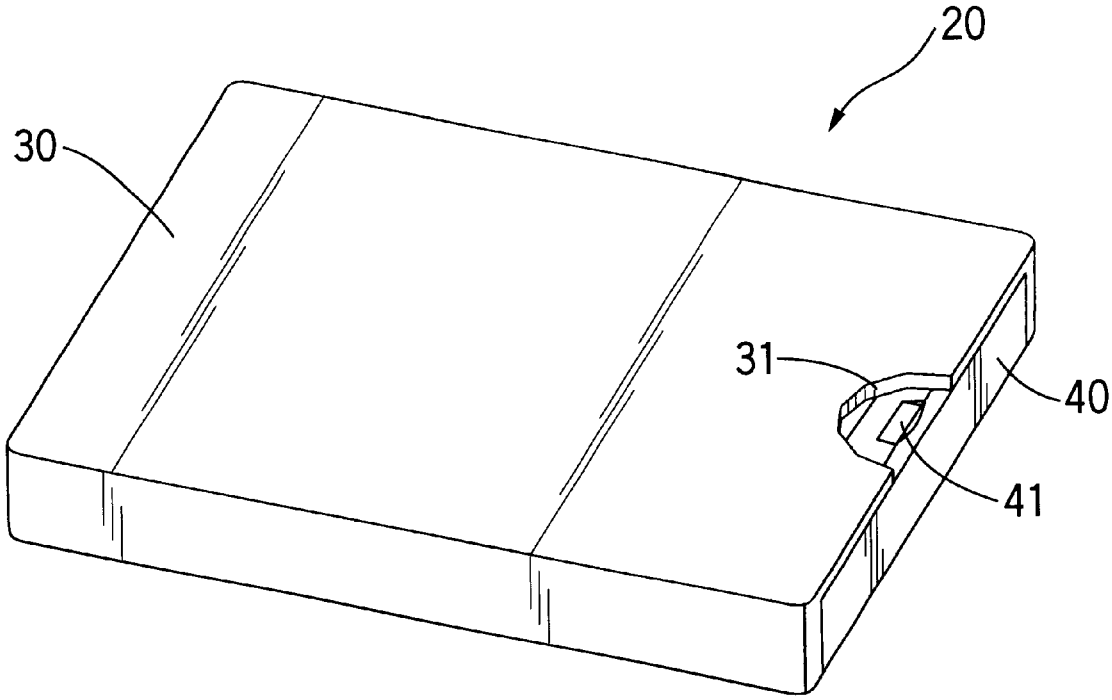
FIG. 2 is a perspective view showing the exterior of a table or base for a telephone or the like associated with a writing device in accordance with the first embodiment of the present invention, the device being shown in an inserted position.
Figure 3:
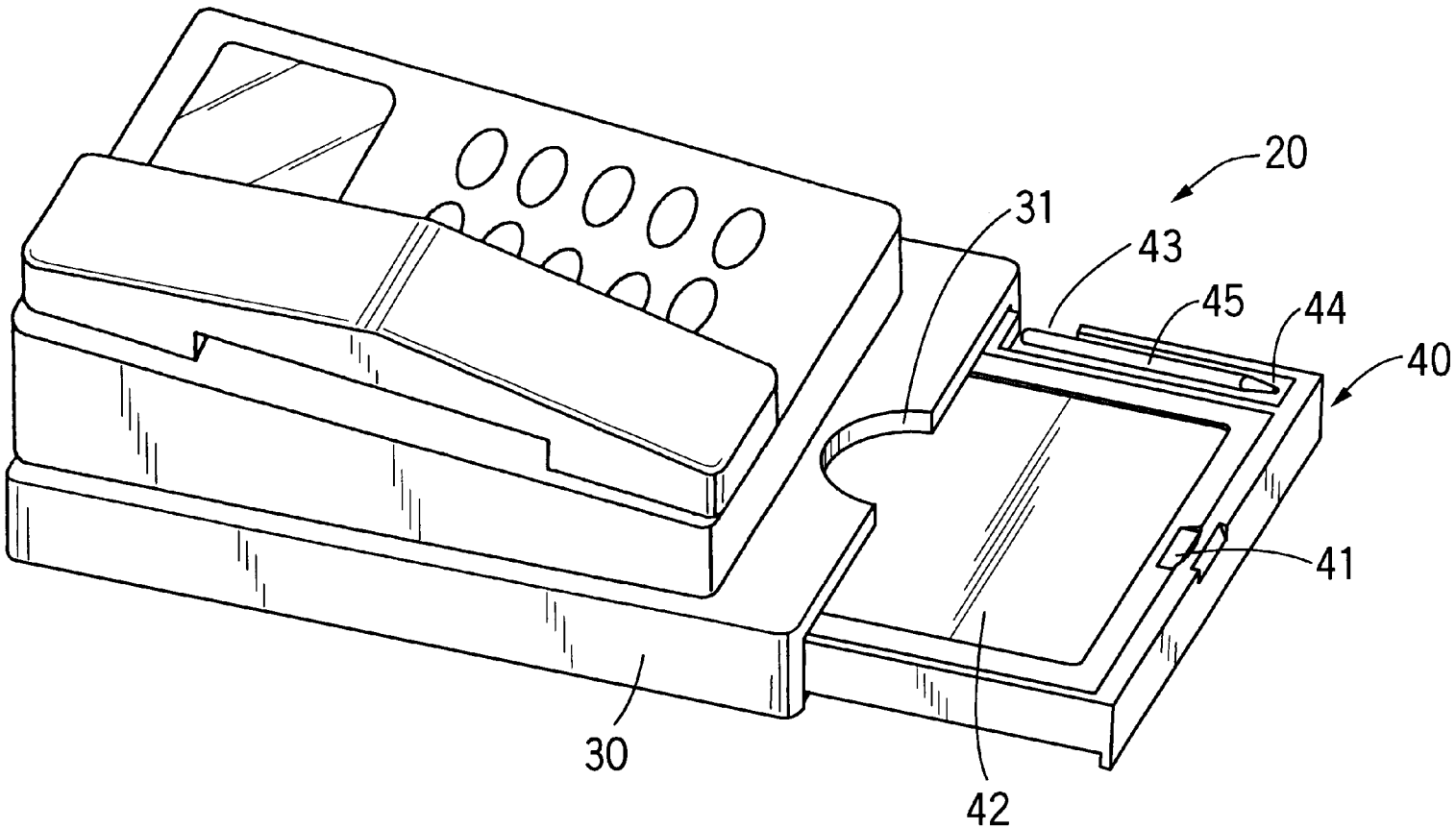
FIG. 3 is a perspective view showing the exterior of the table or base shown in FIG. 2, with the writing device in pulled out position.

FIG. 2 is a perspective view showing the exterior of a table 20 for a telephone or the like having a writing device in accordance with a first embodiment of the present invention, wherein the writing device is shown in a fully inserted position. FIG. 3 is a perspective view showing the exterior of the table shown in FIG. 2, wherein the writing device is shown in a pulled out position. As shown in FIG. 2, the table 20 of the present embodiment has a substantially rectangular, generally planar shape, and comprises an outer case 30 having an open front side and an inner frame member 40 fully inserted into the outer case 30. As shown in FIG. 3, the outer case 30 can be used for placing a telephone or other article. In addition, even if such an article is placed on a top surface of the outer case 30, the table 20 is adapted to allow the inner frame member 40 to be pulled out from the front side opening of the outer case 30 by putting a finger into a notch 31 which is located in the middle of a front edge of a top section of the outer case 30 and then hitching a recess 41, which is located in the middle of a front edge of the inner frame member 40, with the finger. The inner frame member 40 has a substantially rectangular and generally planar shape and can be moved into and out of the outer case through the front side opening of the outer case 30. The inner frame member 40 includes an opening in a top section thereof, and is provided with a recording sheet 42 which includes a microcapsule magnetic sheet and whose top face is exposed through the opening of the top section of the inner frame member 40. The inner frame member 40 is also provided with a pen accommodating recess 44 formed on the right end region of the top section, and a magnetic pen 45 which has a magnet on the top thereof and is accommodated in the pen accommodating recess 44. A notch 43 is provided in a part of a right side of the pen accommodating recess 44, wherein user can write any characters and figures on the recording sheet 42 by using the magnetic pen, and can also accommodate the magnetic pen 45 and recording sheet 42 within the outer case 30 by bringing the magnetic pen 45 back into the pen accommodating recess 44 and then pushing the inner frame member 40 into the outer case 30 after use. In addition, as will be described later, the table 20 of the present invention includes a mechanism for erasing the writing on the recording sheet 42 in conjunction with the motion to accommodate the inner frame member 40 within the outer case 30. Thus, when the user pulls out the accommodated inner frame member 40 again, the precedent writing has already been erased, so that the recording sheet is ready to write.

Figure 4:
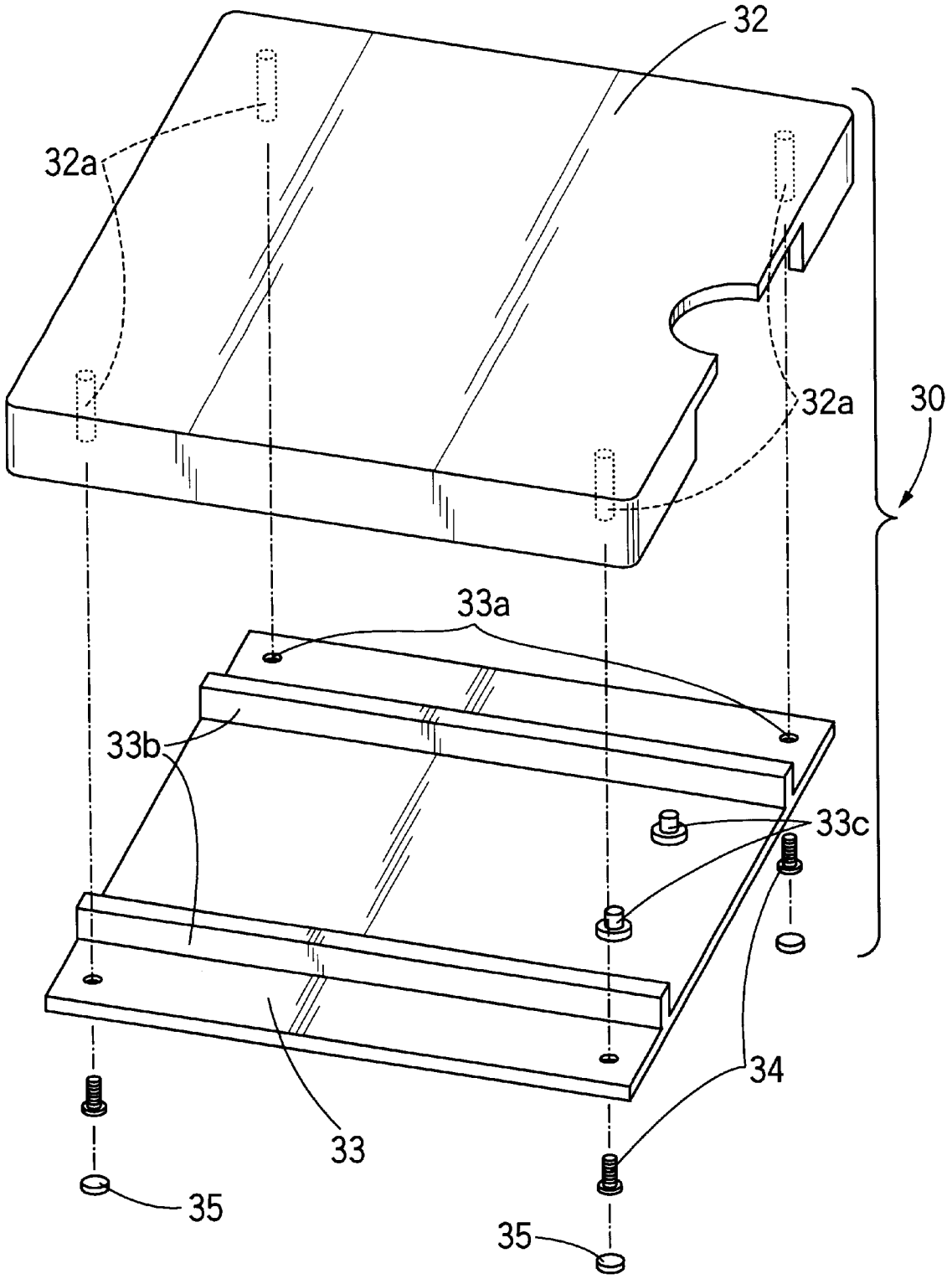
FIG. 4 is an exploded perspective view of the outer case of the embodiment shown in FIG. 2.
Figure 5:
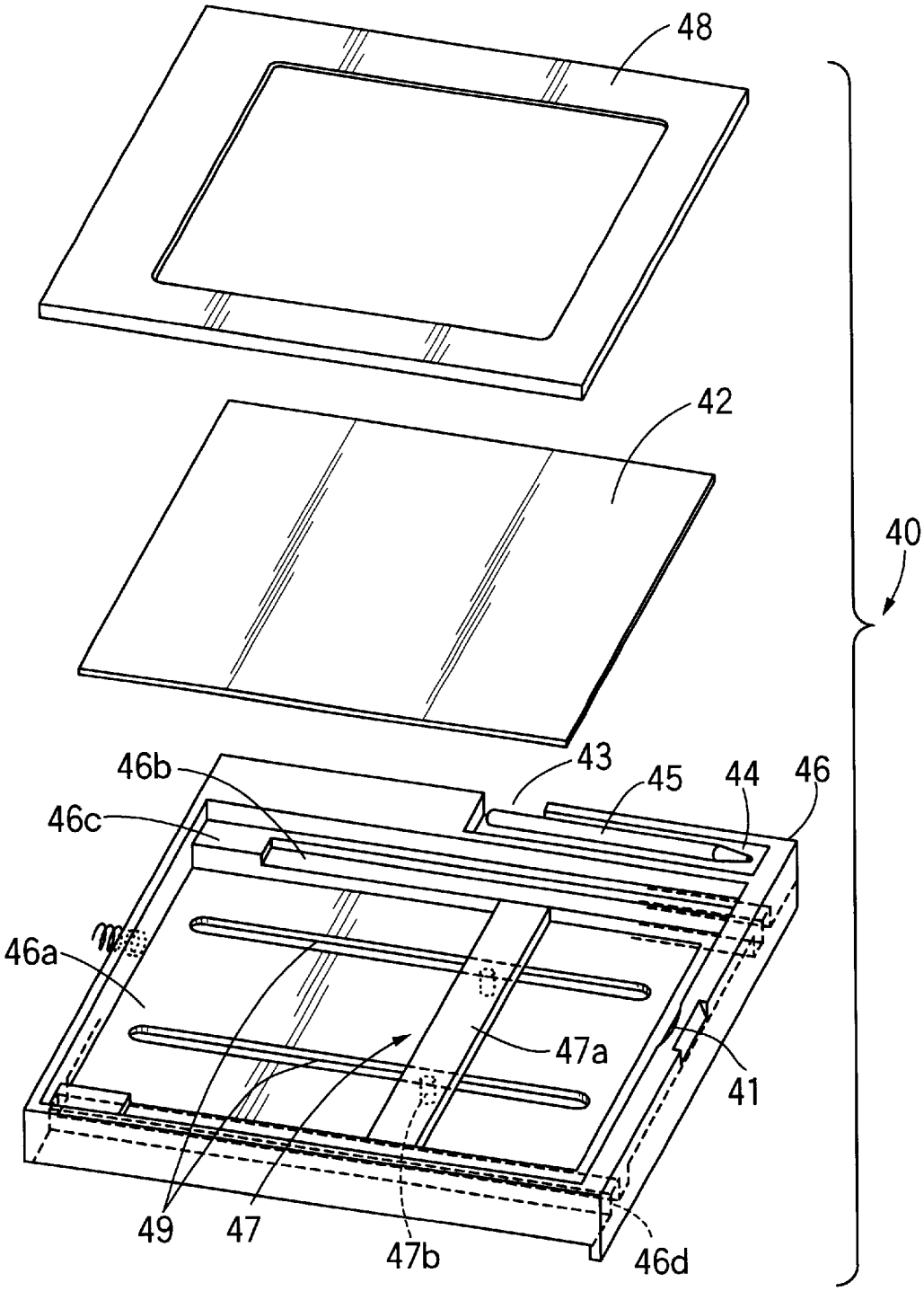
FIG. 5 is an exploded perspective view of the inner frame member of the embodiment shown in FIG. 2.
Figure 6:
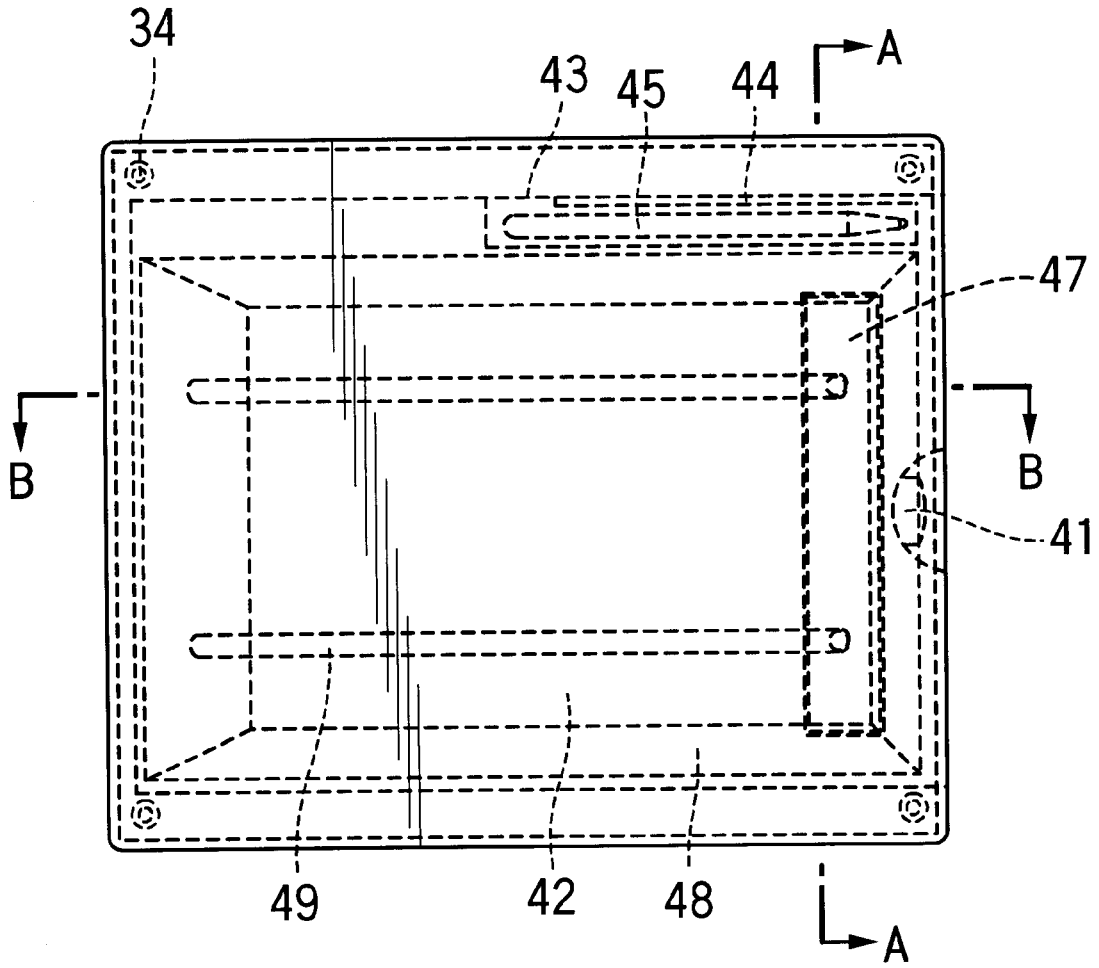
FIG. 6 is a top plan view showing an interior structure of the embodiment shown in FIG. 2, in the inserted position.
Figure 7:
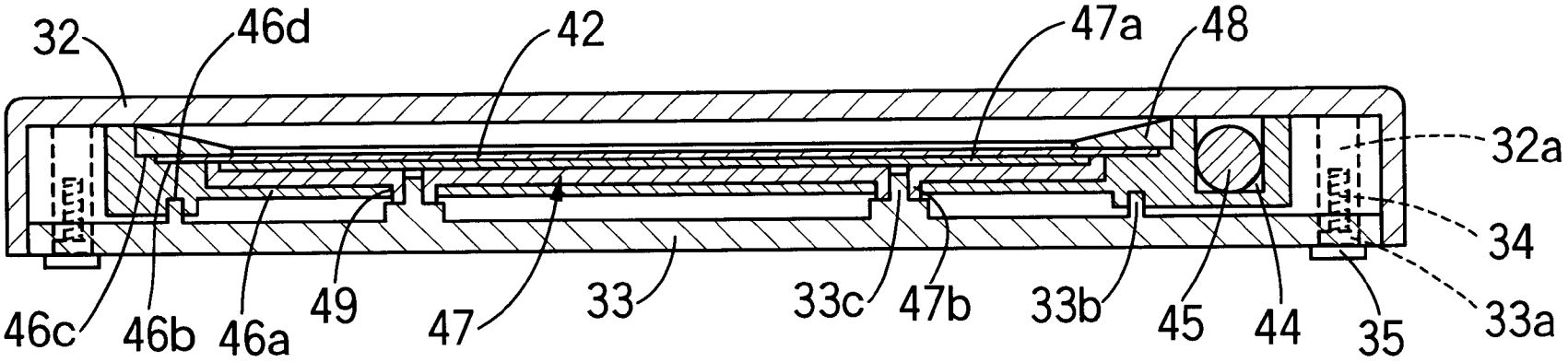
FIG. 7 is a sectional view taken along the line A—A of FIG. 7.
Figure 8:
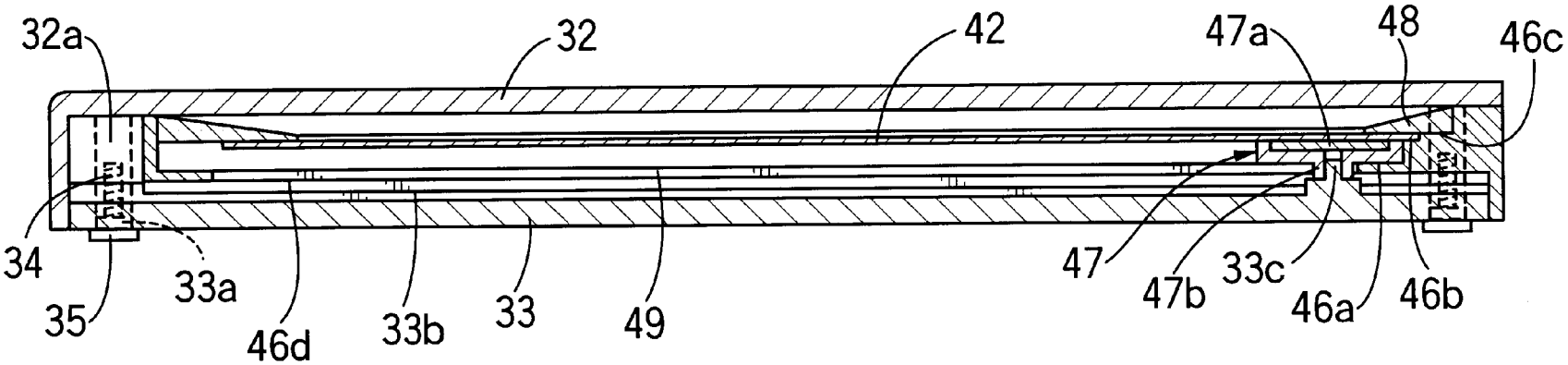
FIG. 8 is a sectional view taken along the line B—B of FIG. 7.
Figure 9:
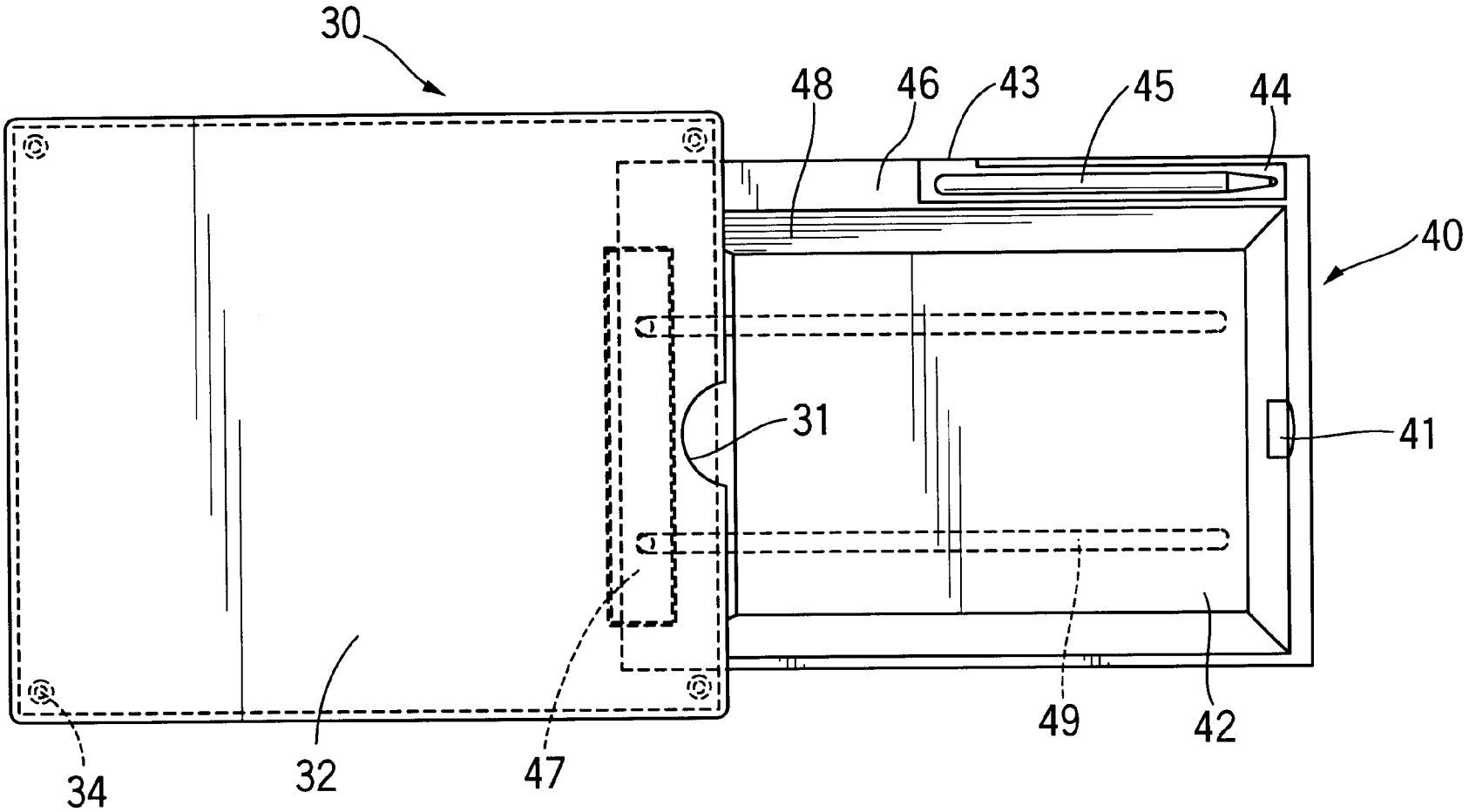
FIG. 9 is a top plan view showing an interior structure of the embodiment shown in FIG. 2, in pulled out state.

FIG. 4 is an exploded perspective view of the outer case of the embodiment shown in FIG. 2. FIG. 5 is an exploded perspective view of the inner frame member of the embodiment shown in FIG. 2. FIG. 6 is a top plan view showing the interior structure of the embodiment shown in FIG. 2, with the inner frame member 40 inserted into the outer case 30. FIG. 7 is a sectional view taken along the line A—A of FIG. 7, and FIG. 8 is a sectional view taken along the line B—B of FIG. 7. FIG. 9 is a top plan view showing the interior structure of the embodiment shown in FIG. 2, with the inner frame member 40 pulled out. As shown in FIG. 4, the outer case comprises a box shaped upper outer case member 32 whose bottom section and front side section are respectively opened, and a plate shaped lower outer case member 33 which forms a bottom section of the outer case 30. A protrusions 32*a* for receiving a screw is provided on each of four corner regions of the top section of the upper outer case member 32. Each of the screw receiving protrusions 32*a* has female threads and is projected downward. A screw hole 33*a* is also provided on each of four corner regions of the lower outer case member 33. Each of the screw holes 33*a* has female threads. An externally threaded screw 34 is inserted from underneath of the lower outer case member 33 through each of the screw holes 33*a* into each of the associated screw receiving protrusions 32*a* to clamp the upper outer case member 32 and the lower outer case member 33. On a lower surface of the lower outer case member 33, a slip stopper made of rubber material is adhesively attached at the position of the screw hole 33*a*. On an upper surface of the lower outer case member 33, a pair of rails 33*b* and a pair of columns 33*c* are provided. The pair of rails 33*b* extends longitudinally in parallel each other, and the pair of columns 33*c* are laterally spaced and positioned between the pair of rails 33*b* at the positions adjacent to the opening of the front side section of the upper outer case member 33.

As shown in FIG. 5, the inner frame member 40 comprises a box shaped inner case member 46 having an open top portion and a bottom plate 46*a*. The inner frame member 40 further includes a rectangular, planar erasing magnetic member 47 including a magnet sheet 47*a* which is bonded to the upper surface of the member 47. A pair of column supports 47*b* are provided on the member 47 to project downward from the lower surface of the member 47. A rectangular recording sheet 42 including a microcapsule magnetic sheet is placed on the inner case member 46 and a rectangular sheet cap 48 having a rectangular center opening is fitted to the inner case member 46 in a manner that the top face of the recording sheet 42 is exposed through the opening of the sheet cap 48 to provide a recording face. The inner case member 46 is formed with a recess for receiving the erasing magnetic member 47 and a supporting portion for supporting the erasing magnetic member 47 is provided by the bottom plate 46*a* of the inner case member. The inner case member 46 has a pair of side members each having a longitudinally extending recess 46*b* for receiving the opposite side edges of the recording sheet 42. The side members are also formed with lands for receiving the opposite side edges of the sheet cap 48. In FIG. 7 and FIG. 8, it will be noted that the erasing magnetic member 47 is located beneath the recording sheet 42, and the sheet cap 48 is located above the recording sheet 42.

In FIG. 5, it will be noted that the bottom plate 46*a* of the inner case member 46 is formed with a pair of elongated slots 49 longitudinally extending in parallel each other substantially throughout the length of the bottom plate 46*a*. As shown in FIG. 7 and FIG. 8, the pair of columns 33*c* of the lower outer case member 33 are inserted into the pair of elongated slots 49 from the bottom side of the bottom plate 46*a*. The pair of column supports 47*b* of the erasing magnetic member 47 are pressed into fitted to the slots 49 from the upper side of the bottom plate 46*a* and engaged with the columns 33*c*, so that the erasing magnetic member 47 is fixed to the lower outer case member 33 maintaining an adequate clearance between the column support 47*b* and the associated slot 49.

Thus, as shown in FIG. 6, FIG. 8 and FIG. 9, the fixed erasing magnetic member 47 is positioned adjacent to the front edge of the outer case 30 and extends throughout the lateral width of the recording face, in a manner that the magnet sheet 47*a* on the upper surface of the erasing magnetic member 47 can contact the bottom face of the recording sheet 42.

As shown in FIG. 5, the inner case member 46 is formed at the bottom surface with a pair of parallel U-shaped recesses 46*d*, which are opened downward and longitudinally extend in parallel each other. The pair of recesses 46*b* are fitted into the pair of parallel rails 33*b* of the lower outer case member 33 with an adequate clearance therebetween as shown in FIG. 7 and FIG. 8.

According to the above structure, the inner case member 46 can longitudinally slide on the rails 33*b* of the lower outer case member 33, and can be moved into and our of the outer case 30 between an inserted position where the inner case member 46 is fully accommodated within the outer case 30 (FIG. 6) and a pulled out position where the inner case member 46 is stopped by the column supports 47*b* of the fixed erasing magnetic member 47. In the position where the inner frame member 40 is fully pulled out, the rear edges of the elongated slots 49 of the inner case member 46 about the associated column supports 47 of the fixed erasing magnetic member 47 so that the inner frame member 40 can be prevented from failing out of the outer case 30.

As shown in FIG. 6 and FIG. 9, in the process that the inner frame member 40 is being inserted into the outer case 30 from the pulled out state, the entire bottom face of the recording sheet 42 slides over the upper surface of the erasing magnetic member 47 which is fixed adjacent to the front edge of the outer case 30, so that the writings on the recording face can be fully erased at the time when the inner frame member 40 is inserted into the outer case 30.

A second embodiment of a writing device cum a telephone and such according to the present invention will hereinafter be described, wherein the parts corresponding to those of the first embodiment are designated by the same reference numerals. In the second embodiment, the erasing magnetic member 47 includes a sliding mechanism for facilitating slidable movement of the inner frame member 40 into and out of the outer case 30. In addition, the table 20 of the second embodiment includes a push release type lock mechanism. In this embodiment, when the inner frame member 40 is accommodated within the outer case 30, the inner frame member 40 is locked to the outer case member 30 to make the inner frame member 40 impossible to be pulled out. The lock can be released by lightly pushing the front side of the inner frame member 40 so as to pull out the inner frame member 40.

Figure 10:
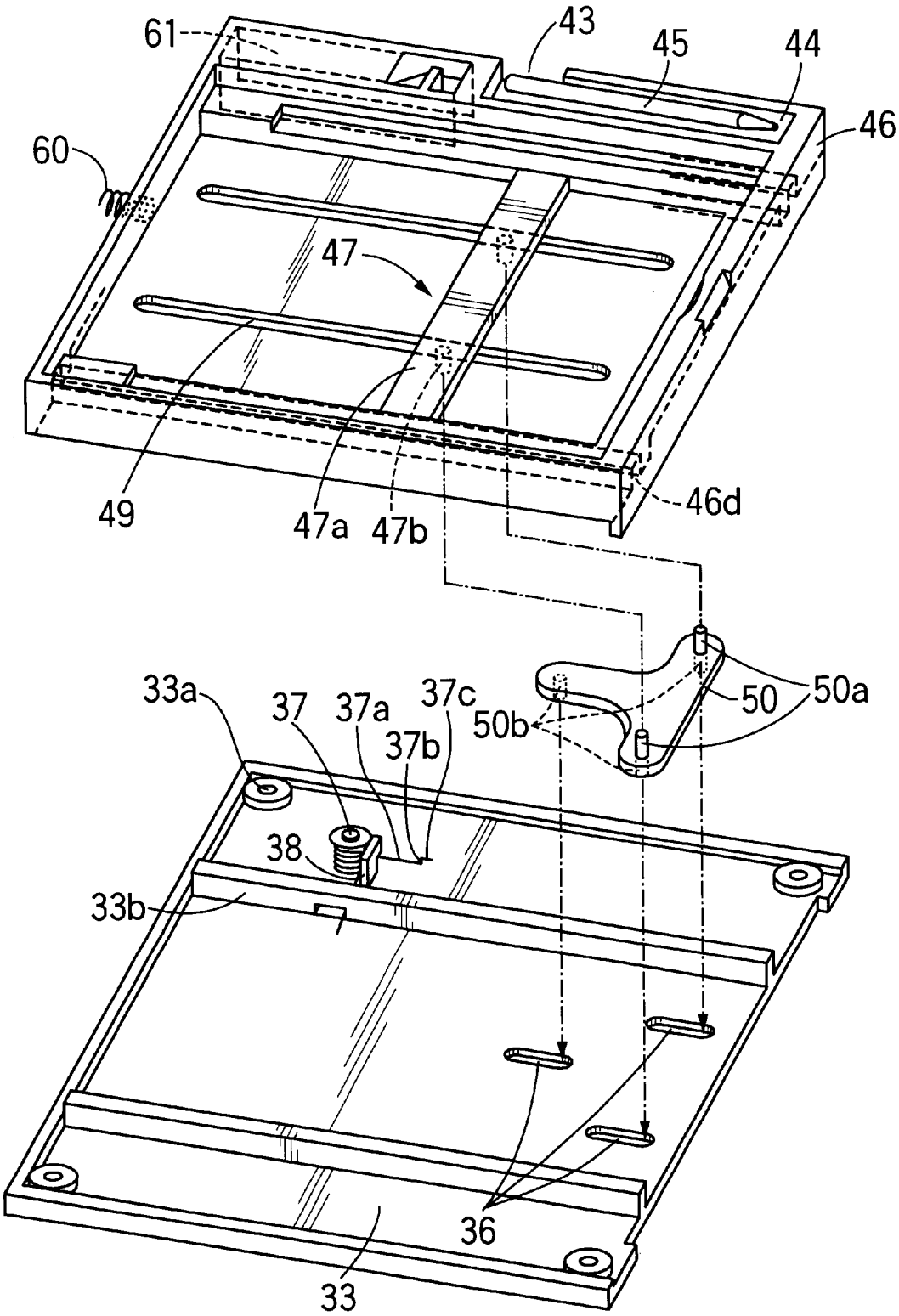
FIG. 10 is an exploded perspective view showing a part of a table or base in accordance with the second embodiment of the present invention.
Figure 11:
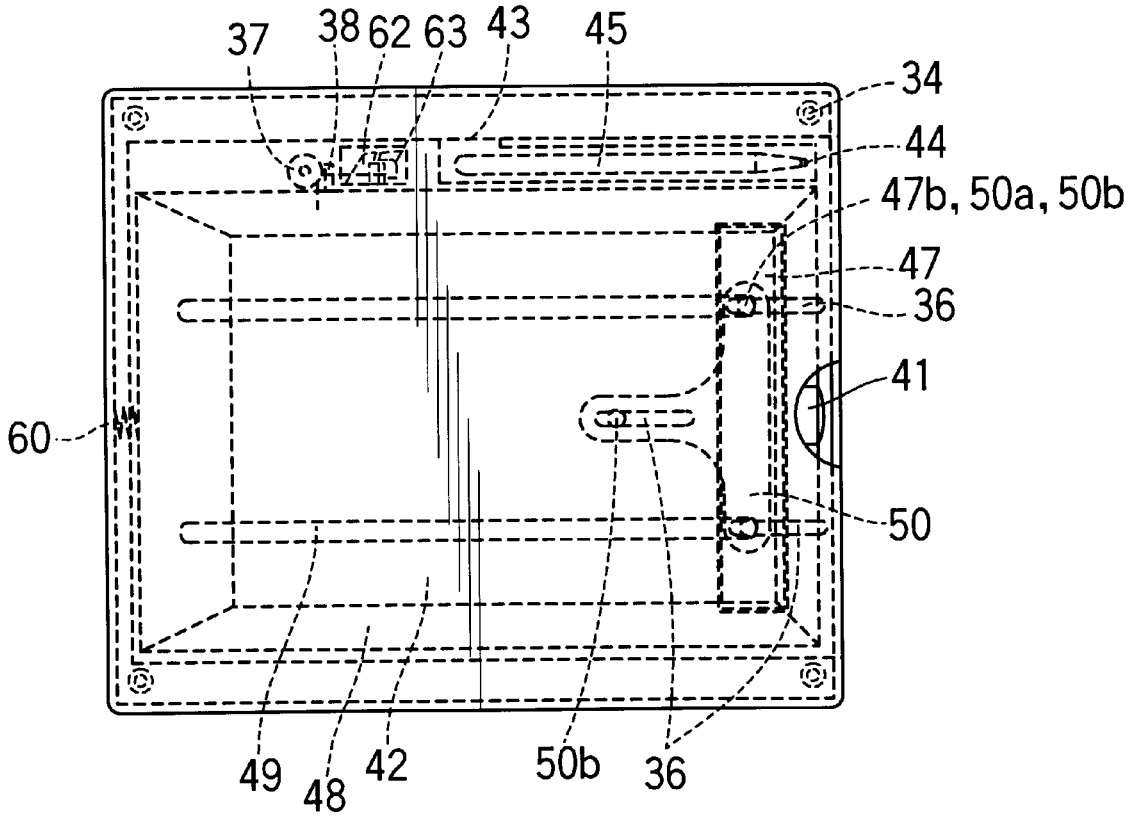
FIG. 11 is a top plan view showing an interior structure of the embodiment shown in FIG. 10, with the recording sheet in the inserted position.

The sliding mechanism will be described hereinafter. FIG. 10 is an exploded perspective view showing parts of the second embodiment of the talk or base for a telephone or the like according to the present invention. FIG. 11 is a top plan view showing the interior structure of the embodiment shown in FIG. 10, with the inner case member in the inserted position. As shown in FIG. 10, the mechanism includes a planar, substantially T-shaped sliding member 50. A pair of upwardly projecting columns 50*a* are formed adjacent to two apex regions on the upper surface of the sliding member 50, and three downwardly extending projections 50*b* are formed adjacent to three apex regions on the lower surface of the sliding member 50. Three parallel short slots are formed to extend longitudinally at positions adjacent to the front edge region of the lower outer case member 33. The three projections 50*b* of the sliding member 50 are fitted into the short slots 36 from the upper side with an adequate clearance. The friction coefficient between the short slots 36 and the projections 50*b* is determined to be extremely small. The pair of columns 50*a* of the sliding member 50 are passed through the pair of the elongated slots 49 from the underside, and the pair of column supports 47*b* of the erasing magnetic member 47 are pressed into and interfitted with the columns 50*a* from the upper side, so that the erasing magnetic member 47 is fixed to the sliding member 50 with an adequate clearance between the column support 47*b* and the associated slot 49.

According to the above structure, when the inner frame member 40 is to be pulled out, the projections 50*b* of the sliding member 50 are first slid in the short slots 36 of the lower outer case member 33, and the inner frame member 40 is slid on the lower outer case member with the sliding member 50 until the inner frame member 40 reaches the position where the projections 50*b* of the sliding member 50 are engaged with the front edges of the short slots 36 of the lower outer case member 33. After reaching the position, the inner frame member 40 is solely slid on the rails 33*b* of the lower outer case member 33. Similarly, when the inner frame member 40 is to be inserted into the outer case 30, the projections 50*b* of the sliding member 50 are first slid in the short slots 36 of the lower outer case member 33, and the inner frame member 40 is slid on the lower outer case member 33 with the sliding member 50 until the inner frame member 40 reaches the position where the projections 50*b* of the sliding member 50 are engaged with the rear edges of the short slots 33 of the lower outer case member 33. After reaching the position, only the inner frame member 40 is slid on the rails 33*b* of the lower outer case member 33. Thus, the friction coefficient can be made very small during the initial movement of the inner frame member 40, and the movement of the inner frame member 40 only will be produced only after a certain amount of inertia is produced after the initiation of the movement. The substantially T shape of the sliding member 50 enables the inner frame member 40 to be positioned reliably in the longitudinal direction without any unstable lateral movement in the pull-out and push-in motions. Thus, it can be achieved to push in and pull out the inner frame member 40 in a highly smooth manner.

Figure 12:
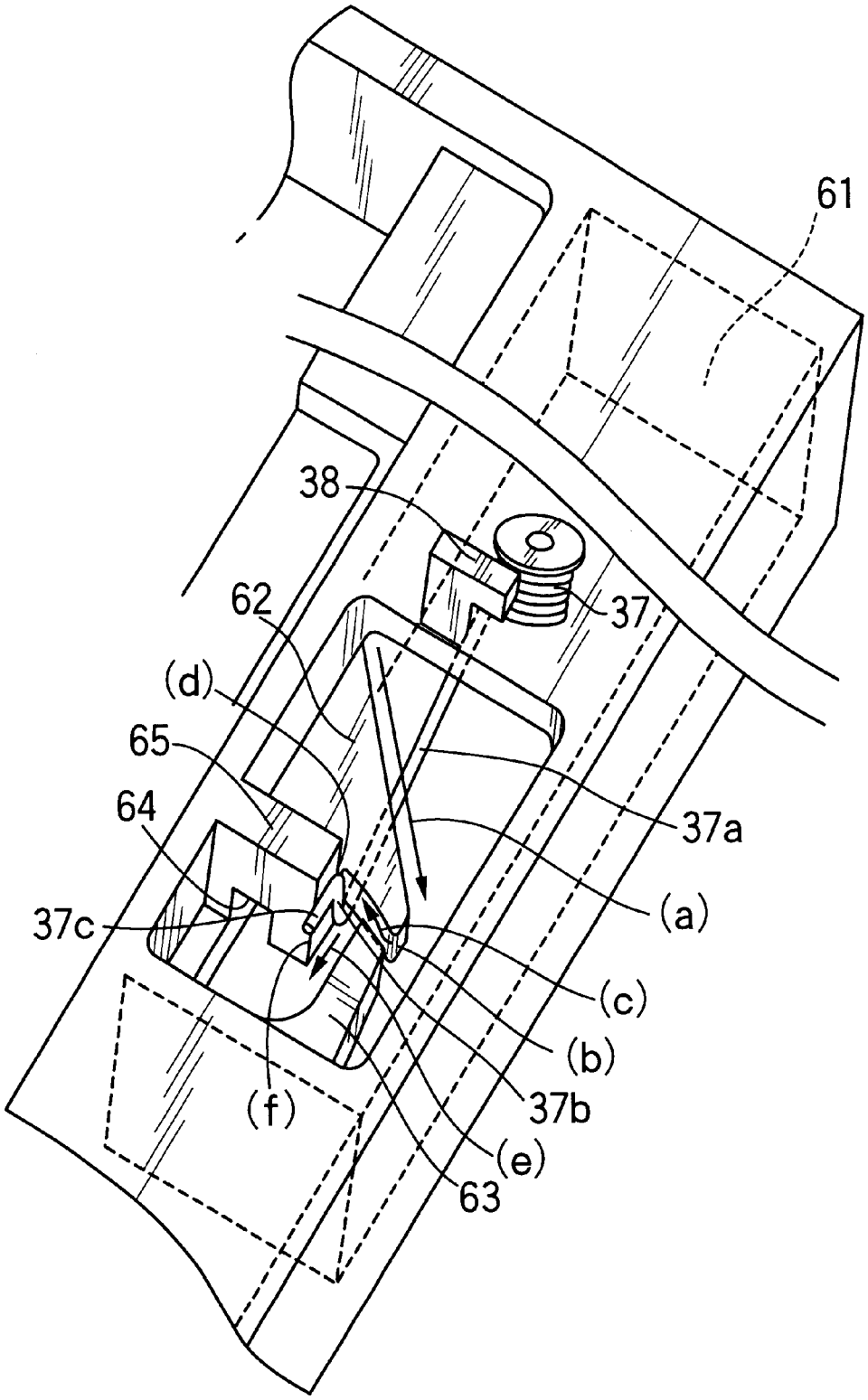
FIG. 12 is a perspective view showing the lock mechanism of the embodiment of FIG. 10.

The lock mechanism will be described hereinafter. FIG. 12 is a perspective view showing the lock mechanism of the embodiment of FIG. 10. As shown in FIG. 10, the lower outer case member 33 is provided at a right-hand rear portion of the upper surface with a torsion coil spring 37 and a column 38. The coil spring 37 has an upper end portion which extends forwardly and is bent in Z-shape so as to provide a horizontal portion 37*a*, a vertical portion 37*b* and a head portion 37*c*. The horizontal portion 37*a* of the torsion coil spring 37 is engaged by the column 38.

A compression spring 60 is attached at the middle of the rear side of the inner case member 46. The inner case member 46 is formed at the rear portion of the right-hand edge portion with a U-shaped recess 61 which is opened downward. The torsion coil spring 37 and the U-shaped recess 61 are positioned so that the torsion coil spring 37 is moved within the U-shaped recess 61 when the inner frame member 40 is moved into and out of the outer case 30. As shown in FIG. 12, there are formed a first projection 62 projecting from the left side of the U-shaped recess 61, and a second projection 63 projecting from the front side of the U-shaped recess 61. The first projection 62 has a triangular planar shape which is horizontally projecting toward right in the U-shaped recess 61 and formed with a rounded tip end. The front side of the first projection 62 extends perpendicularly to the left side wall surface of the U-shaped recess 61. The first projection 62 is formed at the left side of the front side surface with a forwardly and upwardly extended portion 65 which is formed with a downwardly opening U-shaped recess 64. The depth of the recess 64 is gradually decreased toward rearwards. The second projection 63 is of a planar shape and extends in the plain of the first projection 62. The rear edge of the second projection 63 is opposed to the right end portion of the front side of the first projection 62 leaving a certain space which is substantially equal to the wire diameter of the torsion coil spring 37. The torsion coil spring 37, the first projection 62 and the second projection 63 are positioned with respect to each other so that the head portion 37*c* of the torsion coil spring 37 is situated higher than the top surfaces of the first projection 62 and the second projection 63, and the horizontal portion 37*a* of the torsion coil spring 37 is situated lower than the bottom surfaces of the first projection 62 and the second projection 63, when the torsion coil spring 37 is engaged with the first projection 62 and the second projection 63 as the inner frame member 40 is pushed into the outer case 30. The forefront end of the U-shaped recess 64 is of a depth such that the bottom of the recess 64 is at a level higher than the head portion 37*c* of the torsion coil spring 37.

According to the above structure, when the inner frame member is pushed into the outer case 30, the vertical portion 37*b* of the torsion coil spring 37 is contacted to the slanted side (a) of the first projection 62 and then is slid along the side (a) to be shifted in the right direction. In this stage, the compression spring 60 is compressed. When the inner frame member 40 is further pushed in against the resilience of the torsion coil spring 37 and the compression spring 60, and the vertical portion 37*a* of the torsion coil spring 37 is passed through the point (b) of the first projection, the front edges of the slots 49 of the inner frame member 46 are engaged with the column support 47*b* of the erasing magnetic member preventing the inner frame member 40 from being pushed in further. Then, after the push-in motion is thus restrained, the inner frame member 40 capable of being initiated to move with a minimum force by means of the slide mechanism is slightly pushed out frontward by the resilience of the compression spring 60. Simultaneously, the torsion coil spring 37 moves leftward (c) by the own resilience by having the vertical portion 37*b* of the torsion coil spring guided by the sides of the first projection 62 and the second projection 62, and is then restrained by the rear corner (d) at the right side of the extended portion 65. In this state, the inner frame member 40 cannot be pulled out because the side of the first projection 62 is restrained by the vertical portion 37*b* of the torsion coil spring 37. When the inner frame member 40 is pushed into the outer case 30 again from the above state, the vertical portion 37*a* of the torsion spring 37 is slid along the right side (e) of the extended portion 65. Then, when the vertical portion 37*a* of the torsion spring 37 reaches the front corner (f) of the right side of the extended portion 65, the portion 37*b* is disengaged from the portion 65. The torsion coil spring 37 then moves leftward by its own resilience, and is placed under the U-shaped recess 64 wherein the horizontal portion 37*a* is supported by the column 38. Then, the front edges of the slots 49 of the inner frame member 44 are engaged with the column support 47*b* of the erasing magnetic member to prevent the inner frame member 40 from being pushed in further. The push-in motion is restrained, and the inner frame member 40 capable of being moved with a minimum force by means of the slide mechanism is slightly pushed out frontward by the resilience of the compression spring 60. Since the depth of the U-shaped recess 64 is gradually decreased toward rearward direction, the head portion 37*c* of the torsion coil spring can be slid along the U-shaped recess 64 and a bottom surface of the first projection 62 without being restrained by the protruded portion 65. Thus the inner frame member 40 is unimpeded to push out frontward. Then, user can freely pull out the inner frame member 40 by hitching the recess 41, which is provided in the top section of the inner frame member 40, with a finger.

Thus, in the table or base for a telephone or the like in accordance with the present invention, the recording sheet including a microcapsule magnetic sheet is provided as a writing device in the inner frame member so as to expose the top face of the recording sheet through an opening of the top section of the inner frame member which is retractable within the telephone table or the like through the front side opening of the table. In addition, the writing device is adapted to allow the magnetic writing on the recording sheet to be erased when the recording sheet is pushed into the outer case. Accordingly, it is unnecessary to supplement a writing pad and a writing tool, and the upper space of the table can be effectively utilized as a table, as well as the achievement of easily erasing memorandums.

What is claimed is:

1. A table having an erasable writing device, said table comprising:

an outer case;

a recording sheet including a microcapsule magnetic sheet, said recording sheet being movable into and out of said outer case; and an erasing magnetic member disposed within said outer case, said outer case having a top surface on which an article can be placed, said erasing magnetic member being positioned so that it is under said recording sheet when said recording sheet is inserted into said outer case, whereby by pulling out said recording sheet from said outer case the recording sheet is exposed to allow magnetical writing on said recording sheet, and by inserting said recording sheet into said outer case magnetic writings on said recording sheet can be erased under the influence of said erasing magnetic member.

2. A table having an erasable writing device, said table comprising:

an outer case having a front opening and including a flat top plate on which an article can be placed, a side wall and a bottom portion;

an inner frame member which is retractable within said outer case through said front opening of said outer case, said inner frame member having an opening at an upper portion, a recording sheet including a microcapsule magnetic sheet, said recording sheet being fixed to said inner frame member so that a top face of said recording sheet is exposed through said opening at said upper portion, and an erasing magnetic member having a length which extends substantially throughout an entire lateral width of said recording sheet, said erasing magnetic member being disposed within said outer case beneath said recording sheet and slidable in the longitudinal direction with respect to said inner frame member, said erasing magnetic member being secured to a bottom section of said outer case, whereby by pulling out said inner frame member from said outer case said recording sheet is exposed to allow magnetical writing on said recording sheet, and by inserting said inner frame member into said outer case said erasing magnetic member is relatively moved along a back face of said recording sheet so that the magnetic writings on said recording sheet can be erased.

3. A table as defined in claim 2, wherein said inner frame member includes a bottom plate on the underside of said inner frame member, and a pair of longitudinally extending parallel slots are formed in said bottom plate, wherein said erasing magnetic member is disposed opposite to said back face of said recording sheet on the upper side of said bottom plate, and a supporting member is disposed on the underside of said bottom plate, said supporting member being coupled to said erasing magnetic member through said pair of slots, said supporting member being fixed to said bottom section of said outer case.

4. A table as defined in claim 3, wherein said supporting member has a triangular or substantially T shape wherein portions corresponding to two apex regions of said supporting member are coupled to said erasing magnetic member through said pair of slots, and portions corresponding to all apex regions of said supporting member are fixed to said bottom section of said outer case.

5. A table as defined by claim 2, further including a lock mechanism disposed between said outer case and said inner frame member for locking said inner frame member to said outer case in a state that said inner frame member is pushed into said outer case.

* * * * *